United States Patent [19]

Lee

[11] Patent Number: 4,719,738

[45] Date of Patent: Jan. 19, 1988

[54] BLOCK

[76] Inventor: Chang Y. Lee, 285-3, Yugkok-dong Buchon, Kyungki-do, Rep. of Korea

[21] Appl. No.: 505,396

[22] Filed: Jun. 17, 1983

[30] Foreign Application Priority Data

Nov. 22, 1982 [KR] Rep. of Korea ..... 9297

[51] Int. Cl.[4] ..... E04C 2/04

[52] U.S. Cl. ..... 52/607; 52/505; 404/34

[58] Field of Search ..... 52/606, 607, 505, 169.1, 52/169.6, 169.7, 169.8, 169.9, 273, 274, 578; 428/131, 134, 156, 188; 261/94, DIG. 72; 404/34, 36

[56] References Cited

U.S. PATENT DOCUMENTS

| | | | |
|---|---|---|---|
| 741,993 | 10/1903 | Anderson | 52/607 |
| 2,701,959 | 2/1955 | Briggs | 52/505 |
| 2,840,353 | 6/1958 | Muspratt | 165/56 |
| 2,911,204 | 11/1959 | Malone | 261/DIG. 72 |
| 3,000,144 | 9/1961 | Kitson | 52/309.11 |
| 3,030,687 | 4/1962 | Muspratt | 264/74 |
| 3,165,750 | 1/1965 | Tell | 52/607 |
| 3,264,021 | 8/1966 | Artman | 52/589 |
| 3,281,510 | 10/1966 | Louret | 52/607 |
| 3,417,533 | 12/1968 | Sparling | 52/607 |
| 3,766,699 | 10/1973 | Dinkel | 52/607 |
| 3,796,657 | 3/1974 | Pretorius et al. | 210/635 |
| 4,246,305 | 1/1981 | Delattre | 428/131 |
| 4,444,697 | 4/1984 | Gater et al. | 261/118 |
| 4,481,155 | 11/1984 | Frohwerk | 52/604 |

FOREIGN PATENT DOCUMENTS

| | | | |
|---|---|---|---|
| 663669 | 2/1935 | Fed. Rep. of Germany | 52/169.1 |
| 2936640 | 3/1980 | Fed. Rep. of Germany | 52/607 |
| 183485 | 5/1887 | France | 52/607 |
| 32916 | 3/1928 | France | 404/34 |
| 906525 | 1/1946 | France | 52/607 |

*Primary Examiner*—John E. Murtagh
*Assistant Examiner*—Andrew Joseph Rudy
*Attorney, Agent, or Firm*—Kuhn and Muller

[57] ABSTRACT

A block for a building or a pavement is disclosed which has a plurality of longitudinal holes and transverse holes extending through the block and communicating with each other at the intersecting points, recesses formed on the underside thereof, and a plurality of holes extending vertically through the block at the solid portions remaining between the intersecting points of the holes.

9 Claims, 7 Drawing Figures

BLOCK

BACKGROUND

The present invention relates generally to a block or a tile used for a building or a pavement, and more particularly, to a tile or a block having a plurality of holes extending longitudinally and transversely through the block so as to provide light weight, and having high strength in spite of such light weight.

The conventional ceramic tiles according to the prior art have been made by burning them in a furnace. Due to any features in such a manufacturing process, it has not been possible to make a large tile having a size exceeding a constant limit. The term "constant limit" used herein means a square having a side of about 20 cm long. A large size tile having a greater dimension may be bent or cracked on its surface during drying steps following its formation, and also has the reduced strength. Therefore, a high quality tile could not be made due to these problems.

Also, the conventional concrete blocks have a cavity opening in any one direction, and consequently, if the cavity is enlarged so as to reduce weight of a block, strength of the block is decreased, thereby precluding a possible reduction of weight beyond the constant limit.

SUMMARY OF THE INVENTION

In accordance with the present invention a novel and improved block or tile used for a building or a pavement has in its body a plurality of longitudinal, transverse and vertical holes and in its underside a plurality of recesses to overcome the above-described difficulties in the conventional ceramic tiles or concrete.

The present invention will be understood by those skilled in the art from a reading of the following detailed description in conjunction with the accompanying drawings which show the embodiments of the invention for illustration purposes only, but not for limiting the scope thereof in any way.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF DRAWINGS

In the accompanying drawings, forming a part of this specification, and in which reference numerals shown in the drawings designate like or corresponding parts through the same.

DETAILED DESCRIPTION

Figure 1:
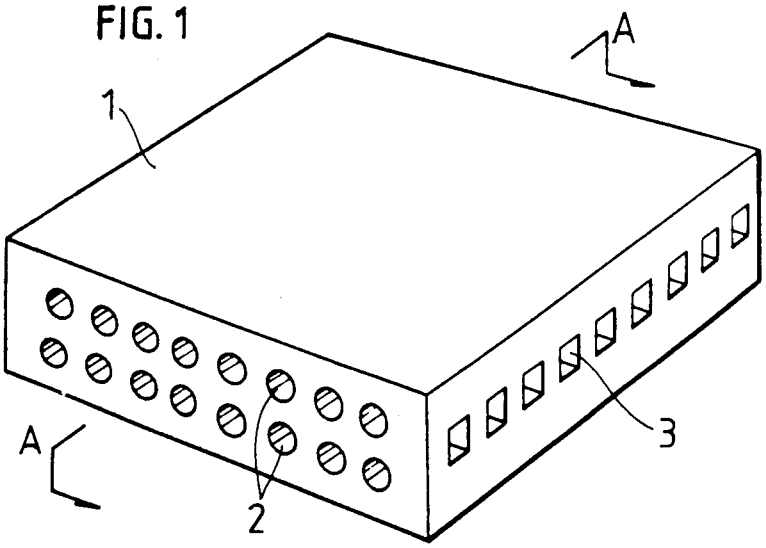
FIG. 1 is a perspective view of an embodiment of a block according to the present invention.
Figure 2:
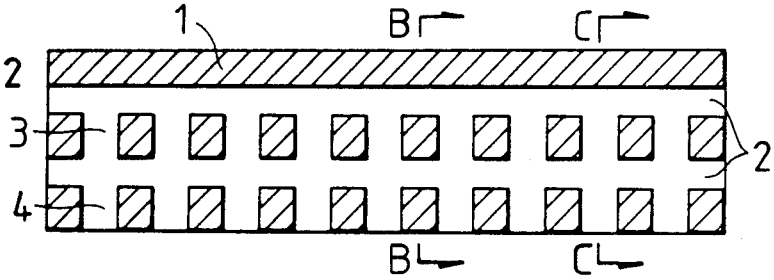
FIG. 2 is a cross-sectional view taken along line A—A of FIG. 1.
Figure 3:
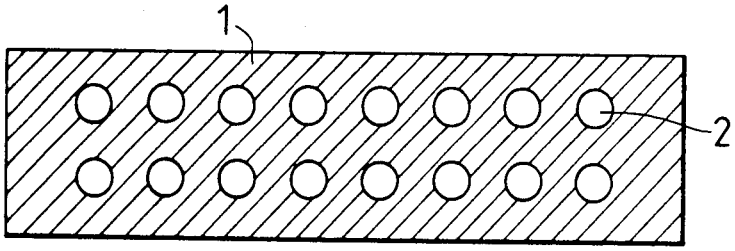
FIG. 3 is a cross-sectional view taken along line B—B of FIG. 2.
Figure 4:
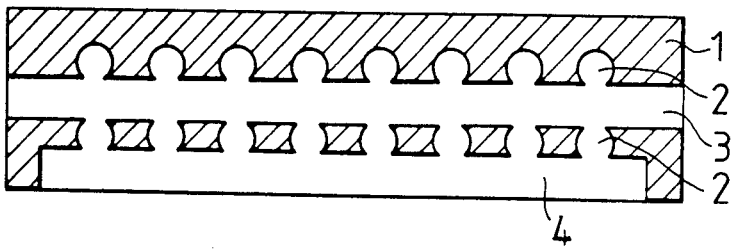
FIG. 4 is a cross-sectional view taken along line C—C of FIG. 2.

FIG. 1 illustrates a perspective view of a preferred embodiment of the present invention particularly suited to provide a tile. The tile comprises a body 1 having a hexahedral shape. The body is provided with a plurality of through holes 2. Although the holes 2 are illustrated as having a circular cross-section, they may have a cross-section of a square or polygonal shape. The holes 2 extend longitudinally from a front side to a back side of the body 1. Each hole 2 has substantially the same cross-sectional dimension. A plurality of holes 3 extend transversely from a left side to a right side and communicating with the longitudinal holes 2. The body further has recesses 4 formed on its underside to extend in the same direction as the transverse holes 3. By intersecting the longitudinal holes 2 with the transverse holes 3 and communicating with each other at the intersecting points, the drying step, followed after the tile is formed, can be effected rapidly and satisfactorily, and during a burning operation a heat can be circulated smoothly and easily. In addition, a uniform cooling can be accomplished in the entire body. The recesses 4 formed on the underside of the tile further promote drying of the tile during the drying operation. Accordingly, it is possible to produce a large tile having a size over the constant limit described above without the occurrence of bending or cracking of the surface of the tile during the forming, drying, burning or cooling operations. Also, as shown in FIG. 2, the remaining solid portions other than the intersecting portions of the holes 2, 3 function as posts to provide the tile with high strength.

Figure 5:
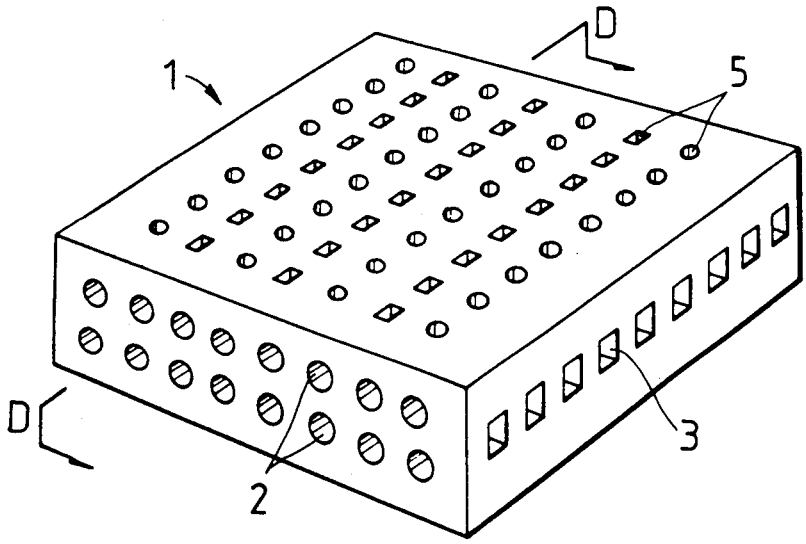
FIG. 5 is a perspective view of another embodiment of the present invention.
Figure 6:
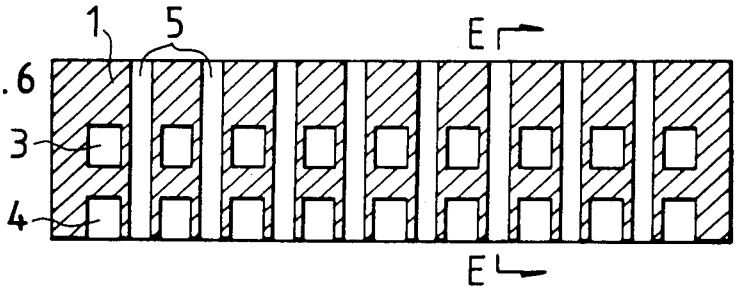
FIG. 6 is a cross-sectional view taken along line D—D of FIG. 5.
Figure 7:
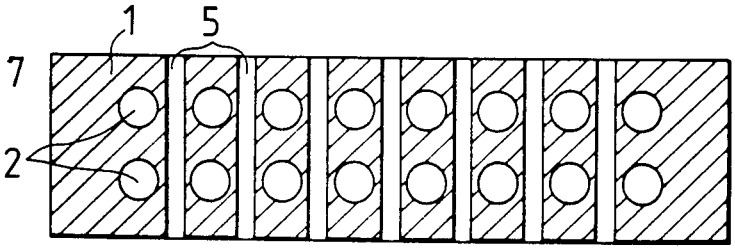
FIG. 7 is a cross-sectional view taken along line E—E of FIG. 5.

FIG. 5 illustrates another embodiment of the present invention particularly useful for a block used for a building or a pavement. As in the embodiment shown in FIG. 1, the body 1 also has a plurality of longitudinal and transverse holes 2, 3 communicating with each other. In addition to the holes, the body further has a plurality of holes 5 extending vertically through it from the top surface to the underside and formed at central portions between the intersecting points of the longitudinal and transverse through holes 2, 3. The vertical holes 5 contribute to the reduction of weight of the block for a large construction. The remaining solid portions other than the intersecting points of the longitudinal and transverse holes 2, 3 and the vertical holes 5 play the role of posts to maintain high strength of the block. The throughholes 2, 3 and the vertical holes 5 can be used to receive inserts for insulating and soundproofing of the building, and inserts of metal or plastic tube for reinforcing the block.

Thus, in accordance with a preferred embodiment of the invention, there is a tile block comprising a body 1 having a generally hexahedral shape. The block has a first plurality of holes 2 horizontally extending in parallel from a first side of the body 1 to an opposite second side of the body. A second plurality of holes 3 horizontally extends in parallel from a third side of the body to an opposite fourth side of the body. The first plurality of holes 2 is extended in a direction transverse to the second plurality of holes 3 and respective ones of the first plurality of holes 2 intersect and communicate with the second plurality of holes 3. Alternatively considered, respective ones of the second plurality of holes 3 intersect and communicate with the first plurality of holes 2. The block has a plurality of recesses 4 in a first surface of the body 1. The first surface is bounded by all of the first, second, third and fourth sides.

The tile block body 1 preferably includes, in one embodiment, a third plurality of holes 5 vertically extending from the first surface to an opposite surface of the body 1. These surfaces generally constitute the lower and upper surfaces of the block when it is placed in use. The third plurality of holes 5 is generally perpendicular to and intermediate said first and second plurality of holes 2, 3.

In one embodiment, said first plurality of holes 2 have a circular cross-section and each of said second plurality of holes 3 have a rectangular cross-section.

As shown in the figures, each hole of said first plurality of holes 2 is disposed serially at equally spaced common axial intervals relative to each other, and each hole of said second plurality of holes 3 is disposed serially at equally spaced common axial intervals relative to each other.

The invention represents an improvement in a tile block of constant limit, i.e., wherein the first surface is square and each of the aforementioned sides has a length of at least 20 cm.

The cross-sectional dimensions of holes 2 and 3 and recesses 4 are a fourth of the height of the block, respectively. The dimensions of the lateral and vertical spacings between the holes 2 are same as a diameter of the hole 2. Also, the lateral spacings between the holes 3 and between the recesses 4 are same as their dimensions. The dimension of the hole 5 is a half of the lateral spacing between the holes 2. The overall dimension of the block according to an example of the present invention is 360 mm×100 mm. Therefore, in the block having such a dimension, a diameter of the hole 2 is 20 mm, sides of the square hole 3 and the recess 4 are 20 mm, respectively, a side or a diameter of the hole 5 is 10 mm, the lateral and vertical spacings between the holes 2 are 20 mm, and the lateral spacings between the holes 3 and the recesses 4 are 20 mm, respectively.

The block according to the present invention consists of a clay, a white clay and a feldspar, and is actually formed in a tunnel kiln under the condition maintained at the pressure of 50–400 Kg/cm$^2$ for 20–35 hours and having the temperature of 1150°–1250° C. for the shocking time of 1–2 hours.

From the above description, it will be understood that the present invention provides a tile or a block used for a building or a pavement which is light in weight and high strength due to the formation of the longitudinal and transverse holes 2, 3 and the vertical holes 5 in a ceramic tile or concrete block for a construction.

I claim:

1. A tile block comprising a body having a hexahedral right parallelepiped shape, said block having a first plurality of holes distributed uniformly along a first side of said body and horizontally extending in parallel from said first side of the body to an opposite second side of the body, a second plurality of holes distributed uniformly along a third side of said body which is perpendicular to said first and second sides, said second plurality of holes horizontally extending in parallel from said third side of the body to an opposite fourth side of the body, the first plurality of holes being extended in a direction transverse to the second plurality of holes and respective ones of the first plurality of holes intersecting and communicating with the second plurality of holes, each of said first and second holes having a predetermined transverse dimension and said body having a first surface bounded by and transverse to all of the aforementioned sides, and a plurality of recesses having a predetermined depth in said first surface of the body, the depth of said recesses being comparable to the transverse dimensions of said first and second holes, wherein said body includes a third plurality of holes vertically extending from said first surface to an opposite surface of the body, and said third plurality of holes being generally perpendicular to and intermediate said first and second plurality of holes.

2. A tile block as set forth in claim 1 wherein each of said first plurality of holes have a circular cross-section and each of said second plurality of holes have a rectangular cross-section.

3. A tile block as set forth in claim 2 wherein each hole of said first plurality of holes is disposed serially at equally spaced common axial intervals relative to each other, and each hole of said second plurality of holes is disposed serially at equally spaced common axial intervals relative to each other.

4. A tile block as set forth in claim 3 wherein the first surface is square and each of the aforementioned sides has a length of at least 20 cm.

5. A tile block as set forth in claim 1 wherein the first surface is square and each of the aforementioned sides has a length of at least 20 cm.

6. A tile block as set forth in claim 1 wherein each of the first plurality of holes has a circular cross-section of a diameter equal to the lateral and vertical spacing between adjacent holes of the first plurality of holes.

7. A tile block as set forth in claim 6 wherein each of the second plurality of holes has a rectangular cross-section with a width equal to the lateral spacing between adjacent holes of the second plurality of holes.

8. A tile block as set forth in claim 7 wherein each of the third plurality of holes has a circular cross-section having a diameter equal to one-half of the diameter of each hole of the first plurality of holes.

9. A tile block as set forth in claim 8 wherein the block consists of clay, white clay and feldspar.

* * * * *